US012270172B2

(12) United States Patent
Turunen et al.

(10) Patent No.: US 12,270,172 B2
(45) Date of Patent: Apr. 8, 2025

(54) APPARATUS AND A METHOD FOR NOISE ATTENUATION IN AN IMPACT PILE DRIVING DEVICE

(71) Applicant: Junttan Oy, Kuopio (FI)

(72) Inventors: Petri Turunen, Kuopio (FI); Markku Koffert, Kuopio (FI)

(73) Assignee: Junttan Oy, Kuopio (FI)

( * ) Notice: Subject to any disclaimer, the term of this patent is extended or adjusted under 35 U.S.C. 154(b) by 856 days.

(21) Appl. No.: 17/601,590

(22) PCT Filed: Apr. 5, 2019

(86) PCT No.: PCT/FI2019/050277
§ 371 (c)(1),
(2) Date: Oct. 5, 2021

(87) PCT Pub. No.: WO2020/201612
PCT Pub. Date: Oct. 8, 2020

(65) Prior Publication Data
US 2022/0170227 A1 Jun. 2, 2022

(51) Int. Cl.
*E02D 13/00* (2006.01)
*E02D 5/04* (2006.01)
(Continued)

(52) U.S. Cl.
CPC ..... *E02D 13/005* (2013.01); *E02D 5/04* (2013.01); *E02D 5/285* (2013.01); *E02D 7/10* (2013.01); *E02D 13/04* (2013.01)

(58) Field of Classification Search
CPC ..... E02D 13/005; E02D 5/04; E02D 5/285; E02D 7/10; E02D 13/04
See application file for complete search history.

(56) References Cited

U.S. PATENT DOCUMENTS 5,259,705 A * 11/1993 Breaux ..... B09B 1/008 405/129.8
10,508,399 B1 * 12/2019 Lee ..... F16J 15/46
2013/0272798 A1 * 10/2013 Paul ..... E02D 5/665 405/252.1

FOREIGN PATENT DOCUMENTS

JP S58182084 U 12/1983
JP S6091626 U 6/1985
(Continued)

OTHER PUBLICATIONS

Japanese Notice of Reasons for Rejection, Application No. JP2021-560422, dated Dec. 13, 2022.
(Continued)

*Primary Examiner* — Kyle Armstrong
(74) *Attorney, Agent, or Firm* — MacMillan, Sobanski & Todd, LLC

(57) ABSTRACT

The invention relates to an apparatus for noise attenuation in an impact pile driving device wherein the apparatus comprises a pile guide being attachable to the lower end of a hammer of an impact pile driving device. The apparatus according to the invention comprises compressing arrangement in connection with the pile guide having at least one compressing element and mechanical, hydraulic or pneumatic compressing means for compressing a pile fitted in to the pile guide transversally by means the at least one compressing element. The invention relates also an impact pile driving device and a method for noise attenuation in an impact pile driving device.

16 Claims, 1 Drawing Sheet

(51) Int. Cl.

| | |
|---|---|
| ***E02D 5/28*** | (2006.01) |
| ***E02D 7/10*** | (2006.01) |
| ***E02D 13/04*** | (2006.01) |

(56) References Cited

FOREIGN PATENT DOCUMENTS

| | | | |
|---|---|---|---|
| JP | 2010180689 | A | 8/2010 |
| JP | 2012531544 | A | 12/2012 |
| JP | 2014517178 | | 7/2014 |
| JP | 2017516929 | | 6/2017 |
| JP | 2017160615 | A1 | 9/2017 |
| KR | 100996300 | B1 | 11/2010 |
| SU | 614170 | A1 | 7/1978 |
| SU | 1118743 | A2 | 10/1984 |
| WO | 2010151121 | A2 | 12/2010 |
| WO | 2012177131 | A1 | 12/2012 |
| WO | 2015044897 | A1 | 4/2015 |
| WO | 2015187015 | A1 | 12/2015 |
| WO | 2016028151 | A1 | 2/2016 |

OTHER PUBLICATIONS

Russian Federal Service For Intellectual Property Search Report, dated Aug. 12, 2022, Application No. 201129052.
PCT International Search Report and Written Opinion, Application No. PCT/FI2019/050277, dated Dec. 18, 2019.
The International Preliminary Report on Patentability, Application No. PCT/FI2019/050277, dated Mar. 23, 2021.

* cited by examiner

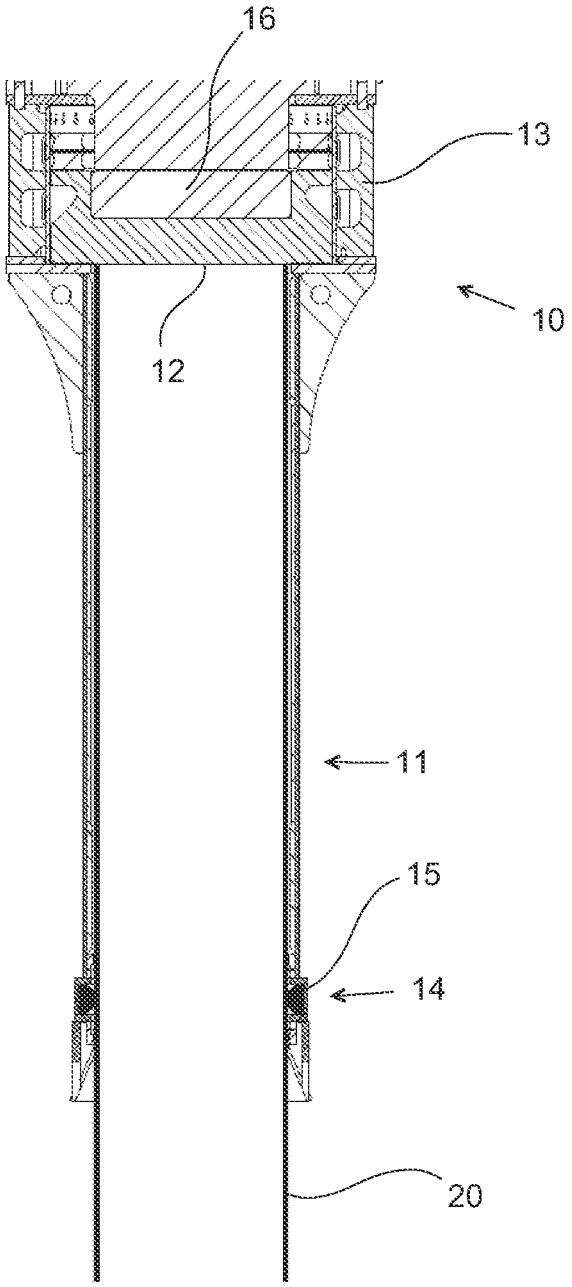
16
13
10
12
11
15
14
20

APPARATUS AND A METHOD FOR NOISE ATTENUATION IN AN IMPACT PILE DRIVING DEVICE

TECHNICAL FIELD

The invention relates to an apparatus and a method for noise attenuation in an impact pile driving device. The invention relates also an impact pile driving device equipped with the apparatus according to the invention.

BACKGROUND

The use of pile driving as a method of foundation of buildings and constructions has become widespread in recent years, for example because land for building is becoming sparse in the vicinity of many large cities, and piles driven into the ground can be used to provide a strong foundation even in areas where building is otherwise not possible because of the low bearing capacity of the soil. Furthermore, the development of more efficient pile driving machines used for driving piles, and the pile driving devices of the machines, as well as the decrease in the costs caused by pile driving, have made foundations based on pile driving less expensive and thereby more competitive than before, compared with alternative foundation solutions.

A factor that has conventionally limited the use of pile driving is that driving piles into the ground by hammering causes relatively loud noise which can be found intrusive in the immediate surroundings (for example in a residential area). In noise investigations on impact pile driving devices, the noise has been found to be produced in the hammer ram of the impact pile driving device when the massive part moving back and forth in connection with the frame of the hammer ram, that is, the ram block, hits a drive cap housing placed on top of the pile, which will transfer the impact to the pile to be driven into the ground, whereby intensive momentary impact and mechanical contact causes that the pile begins to vibrate and ring in its natural frequency, particularly in the case of steel piles. Such ringing and vibration will emit pronounced pressure variation, i.e. noise, to the environment. Without noise protection, the noise level in the vicinity of the impact pile driving device is typically 130-140 dB or even more during the impact driving of the pile into the ground (particularly in the case of steel piles). This drawback has limited the use of impact pile driving particularly in areas where the noise has a very harmful effect, such as in densely populated residential areas. Naturally, the high noise level during the use of the impact pile driving device is also harmful to the operators of the impact pile driving device and other persons working on the construction site. Because of the noise, impact pile driving is often replaced by other pile driving methods which are less effective and more expensive, and which impose a heavier burden on the environment.

For reducing the noise level, various noise suppression solutions for impact pile driving devices have been developed. The aim has been to make the structures of the hammer ram as noise suppressing as possible, and noise reducing devices, to be installed around the pile driving hammer and the pile to be driven into the ground, have been developed for suppressing the noise caused by the pile. According to tests and experiments made by the applicant, the solutions developed for the hammer ram and the drive cap have a limited effect. The use of noise reducing devices installed around the hammer and pile, in turn, involves the drawback that the pile remains invisible within the noise reducing device, whereby the pile driving operation cannot be followed visually. Moreover, the use of such a noise reducing device requires that the device is installed around the hammer and pile each time before starting the impact driving of a new pile into the ground. Naturally, this makes the whole pile driving process slower and more complicated.

SUMMARY

It is the aim of the invention to introduce a new apparatus and method for reducing noise caused by impact driving of steel piles into the ground that is more effective and more advantageous than the noise suppression solutions of prior art. The aim of the invention is also to introduce an impact pile driving device equipped with such a noise reduction apparatus, as well as a method for reducing noise in an impact pile driving device.

The aim of the invention is achieved by the apparatus and method according to the invention, because in such apparatus and method the pile is compressed from its upper portion (preferably at the point of at least one vibration node of the pile) and because the pile is centralized with the central axis of the hammer and drive cap which reduces generation of transversal vibration of the pile.

Furthermore, the aim of the invention is also achieved because due to apparatus according to the invention the upper end part of the pile is covered by the closed pile guide down to which noise (i.e. so called air-noise) caused by the impacts of the ram block to the drive cap and drive caps sudden contacts to the pile is significantly reduced. To put it more precisely, the apparatus according to the invention is characterized in what will be presented in the independent claim 1, the impact pile driving device by what will be presented in the dependent claim 12, and the method according to the invention by what will be presented in the dependent claim 13. Dependent claims 2 to 11 disclose some preferred embodiments of the apparatus according to the invention, and dependent claims 14 to 16 disclose some preferred embodiments of the method according to the invention.

According to noise measurements taken on impact pile driving devices, significantly lower noise levels are achieved by the arrangement according to the invention, formed by the above described principles, than by impact pile driving devices without such arrangements. In noise measurements taken on the impact pile driving device equipped with the pile guide with the apparatus according to the invention, the sound pressure emitted to the environment during the pile driving was reduced by up to about n 3-5 dB which in practise means significant reduction of the harmful effects caused by the noise levels formed by driving process of sheet metal piles without such a noise reduction arrangement.

It is worth noting that in the present patent application, the piles to be driven into the ground by an impact pile driving device are so-called metal sheet piles which are typically made of metal sheet, preferably steel plate profiles with a closed or open cross-sectional profile. Thus, the metal sheet piles referred in this application can be either piles formed of pipes with a circular, rectangular or another cross section, or piles formed of open profiles with a sheet structure, such as I, L, T, Z, or H profiles. Moreover, the metal sheet piles referred to in this application can be metal sheet piles with thin walls, formed of so-called sheet piling profiles. In this application, the term "steel pile" refers to piles made of sheet steel material which may be, for example, hot rolled or cold rolled sheet steel. Moreover, the steel pile is not limited in any way by the thickness of the wall of the pile, although the steel pile here refers to a pile which is hollow inside and has a wall thickness which is often quite small in relation to the outer dimensions (e.g. the diameter) of the pile. The method according to the present invention can be, however, applied also for all kinds of concrete piles.

BRIEF DESCRIPTION OF THE DRAWINGS

In the following, the invention will be described in more detail with reference to the appended drawing which shows the vertical cross-section of an upper portion of a steel pile in an impact pile driving device equipped with the apparatus according to the invention.

DETAILED DESCRIPTION OF SOME ADVANTAGEOUS EMBODIMENTS OF THE INVENTION

The embodiment of the apparatus shown in the FIG. 1 comprises a pile guide 11 being attachable to the lower end of a hammer 10 of an impact pile driving device. Pile guide 11 is normally used to help guiding a pile 20 properly against a drive cap 12 in a drive cap housing 13 at the lower end of the hammer 10 which drive cap may comprise a cushion 16 (as it is shown in the FIG. 1). The pile guide 11 shown in the FIG. 1 comprises a compressing arrangement 14 for compressing the pile 20 transversally (i.e. perpendicular direction to the direction of the driving) from around it's cross section by means of a compressing element 15. The minimum requirement for such compression is that the pile 20 is compressed transversally at one vertical position from two compressing points that are opposite to each other in respect of the pile 20. However, in the embodiment shown in FIG. 1 the compressing element 15 compresses the pile 20 evenly around its whole or at least several portions of its the cross-section which portions are opposite to each other in respect of the pile. The compressing pressure used in compression is in the embodiment of the FIG. 1 at least 0.1 MPa.

In the embodiment shown in FIG. 1 the compressing arrangement 14 is located at the lower end of the pile guide 11. However, the compressing arrangement 14 may be placed also in the other positions between the upper and lower end of the pile guide 11. Furthermore, in other embodiments there may be two or more compression arrangements between the upper and lower ends of the pile guide.

In case of embodiment shown in the FIG. 1 the compressing element 15 is an inflatable cushion which is arranged to compress the pile 20 when the pile 20 is fitted in to the pile guide 11 and the compressing element 15 is inflated. In this case the compressing arrangement 11 is designed for compressing piles having circular cross-section. Therefore the compressing element 15 is, in this case, a ring-like tube which is inflated to compress the pile evenly around its outer circumference. Thus, when using the apparatus shown in the FIG. 1 the pile 20 is fitted normally through the pile guide 11 against the drive cap 12 in the drive cap housing 13. Then, before starting the hammer, the compressing element 15 of the compressing arrangement 14 is inflated such that suitable compressing pressure is achieved (i.e. at least 0.1 MPa). After that when the pile driving is started the pile 20 is centralized in the middle of the drive cap 12 such that the central axis of the pile and the central axis of the moving ram block of the hammer coincide. The compressing element 15 also seals the clearance between the lower end of the pile guide 11 and the pile 20 as well as supports the pile during the whole piling process. After the pile has been driven appropriately in to the ground the compressing element 14 is deflated which releases the compression pressure and the pile guide 11 can be removed on the upper end of the pile 20 in ordinary manner.

The compressing arrangement 14 reduces the noise caused by the pile driving because the inflatable compressing element 15 when inflated supports the pile transversally, prevents the air-sound (formed by the hits of the ram block to the drive cap 12) from coming outside the guide bar and centralizes the pile in respect to the hammer 10 and drive cap 12. Transversal supporting reduces the noise because it damps the vibration of the pile 20. Centralizing ensures that direction of the impact energy is parallel and aligned with the longitudinal central axis of the pile 20 and therefore transversal components of the impact energy (which increase vibration of the pile 20) remain as small as possible.

The compressing arrangement can be also formed by means of one or more compressing elements which is arranged to press the pile 20 when they are moved or turned closer to each other. This type of compressing elements can have e.g. a metal body wherein the sliding surface which is compressed against the pile 20 is covered by some suitable sliding material such as plastic or felt cloth. Moving or turning such compressing elements against the pile 20 can be accomplished by means of mechanical, hydraulic or pneumatic means.

Also this type of compressing arrangements supports the pile 20, prevents or at least limits the formation of air-sound as well as centralizes the pile 20 in respect to the hammer 10 and drive cap 12.

In an embodiment of the apparatus the compressing arrangement comprises a wedge mechanism or an eccentric mechanism for moving and pressing the at least one compressing element against the pile 20. The wedge mechanism may comprise e.g. a wedge surface at the at least one compressing element and a counter surface in the pile guide 11 such that when the at least one compressing element is moved along the counter surface in respect of the pile guide 11 the at least one compressing element moves against the pile 20. The counter surface may be e.g. inner surface of the pile guide 11 at the lower end of the pile guide 11. For securing the at least one compressing element against the counter surface of the pile guide 11 the pile guide 11 may include some kind of guide bars or corresponding members or elements which has been arranged to hold the at least one compressing element inside the lower end of the pile guide 11 such that wedge surface of the at least one compressing element is against the counter surfaces of the pile guide 11 and that the at least one compressing element can move along the counter surface suitable distance such that the at least one compressing element is simultaneously moved transversally towards the pile 20 in order to compress the pile 20.

In an embodiment of the apparatus the at least one compressing element has been attached to the pile guide 11 movably such that friction force between the pile 20 and the at least one compressing element moves the at least one compressing element limited distance in the driving direction of the pile 20 along the counter surface of the pile guide 11 such that the at least one compressing element is pressed against the pile 20 by a predetermined pressure. Limiting the moving distance can be accomplished e.g. by means of some suitable stopping members being located at distance from the upper and lower end surfaces of the at least one compressing element in the upper and lower side of the at least one compressing element. Thus, the stopping member at the lower side of the at least one compressing member will stop the movement of the at least one compressing element when the at least one compressing element moves with the pile 20 in the driving direction due to friction force between the at least one compressing element and the pile 20. Therefore, the stopping members prevent the compressing pressure between the at least one compressing element and the pile 20 from increasing too high. Furthermore, in such embodiment the position of the stopping members can be adjustable in order to adjust the compressing pressure some suitable value which cause optimal noise reduction but does not have any disadvantageous effects (such as too much friction) on the pile driving process itself.

In an embodiment of the apparatus the compressing arrangement comprises eccentric mechanism which tightens the compressing element of the compressing arrangement e.g. by utilizing mechanical energy of the hammer 10 when the hammer 10 is lowered on the upper end of the pile 20. Thus, in such embodiment the eccentric mechanism may comprise e.g. an eccentric wheel which outer surface has been arranged against the at least one compressing element such that when the eccentric wheel is rotated the at least one compressing element moves against the pile 20.

Preferably the apparatus according to the present invention is applied for steel piles having circular, rectangular or another cross section. However, the apparatus can be also applied for steel piles having open profiles, such as I, L, T, Z, or H profiles.

In order to compress the whole cross-section of the pile 20 the inflatable compressing element 15 and other types of compressing elements have to has a shape which match the shape of the cross-section of the pile to be compressed. For instance pile having circular cross-section can be compressed by an inflatable compression element that is a ring-shaped tube (as the case is with the embodiment of FIG. 1). For rectangular cross-section the shape of the tube may rectangular or there may be e.g. four separate inflatable cushions for each side of the pile. For the open profiled piles the shape of the surface coming against the pile has to conform the shape of the cross-section of the open profile. In case of applying transversally movable or turnable compressing elements (such as compressing elements made of metal and having plastic or felt cloth material on the surface coming against the pile) the required minimum amount of compressing elements are two for circular cross section or L-profile. For the rectangular cross section as well as for I, Z or H profiles preferably four compressing elements are needed.

The apparatus according to the invention can be realized in many ways different than the embodiments described above. The compressing arrangement of the apparatus according to the invention can e.g. comprise instead of above described wedge mechanism or eccentric mechanism moving means for moving the compressing elements that is/are formed of one or more hydraulic, pneumatic or electric linear actuators (e.g. cylinders or linear motors) that moves the at least one compressing element against the pile. In an embodiment of the invention the compressing arrangement comprises a tightening belt that is arranged around the at least one compressing element. Thus, when compressing the pile the tightening belt is tightened by shortening its length such that the tightening belt compresses the at least one compressing element against the outer surface of the pile. The advantage of using such tightening belt is that several blocks can be moved against the outer surfaces of the pile to be compressed by means of a single actuator (e.g. a hydraulic cylinder/motor or electric motor) or mechanical means utilizing e.g. the potential energy of the hammer. Thus, in such embodiment the tightening belt can be e.g. like a hose clamp which is actuated by e.g. a hydraulic, electric motor or by means of the potential energy of the hammer when the hammer is lowered on the pile before starting the pile driving process. Furthermore, in all embodiments of the apparatus the apparatus may additionally comprise noise shield on the pile guide. The noise shield may be made of rubber matt, felt cloth matt or corresponding material and extend from the lower end of the pile guide to the lower end of the hammer.

The invention is not limited to the embodiments described above but can vary within the scope of the appended claims.

The invention claimed is:

1. An apparatus for noise attenuation in an impact pile driving device of metal sheet or concrete piles wherein the apparatus comprises a pile guide being attachable to the lower end of a hammer with a moving ram block of an impact pile driving device and a drive cap, wherein the apparatus comprises a compressing arrangement in connection with the pile guide having at least one compressing element and mechanical, hydraulic or pneumatic compressing means for compressing a pile fitted in to the pile guide transversally by means the at least one compressing element such that the pile is centralized in the middle of the drive cap, and that the central axis of the pile and the central axis of the moving ram block of the hammer coincide.

2. The apparatus according to claim 1, wherein the compressing arrangement has been arranged to compress the pile by the at least one compressing element around the cross-section of the pile.

3. The apparatus according to claim 1, wherein the compressing pressure of the compressing arrangement is at least 0,1 MPa.

4. The apparatus according to claim 1, wherein the compressing arrangement is located at the lower end of the pile guide, upper end of the pile guide or in any position between the lower end and upper end of the pile guide.

5. The apparatus according to claim 1, wherein the at least one compressing element comprises at least one inflatable cushion to compress the pile.

6. The apparatus according to claim 1, wherein the compressing arrangement comprises a wedge mechanism or an eccentric mechanism for moving and pressing the at least one compressing element against the pile.

7. The apparatus according to claim 6 wherein the wedge mechanism comprises wedge surface at the at least one compressing element and a counter surface in the pile guide such that when the at least one compressing element is moved along the counter surface in respect of the pile guide the at least one compressing element moves against the pile.

8. The apparatus according to claim 7 wherein the at least one compressing element is attached to the pile guide movably such that friction force between the pile and the at least one compressing element moves the compressing element limited distance in the driving direction of the pile along the counter surface of the pile guide and thus the at least one compressing element is pressed against the pile by a predetermined pressure.

9. The apparatus according to claim 5 wherein the eccentric mechanism comprises eccentric wheel which outer surface has been arranged against the at least one compressing element such that when the eccentric wheel is rotated the at least one compressing element moves against the pile.

10. The apparatus according to claim 1, wherein the at least one compressing element comprises sliding surface placeable against the surface of the pile for ensuring suitable amount of friction between the at least one compressing element and the surface of the pile.

11. The apparatus according to claim 1, wherein the pile guide comprises a noise shield extending at least from the lower end of the pile guide to the lower end of the hammer.

12. An impact pile driving device of metal sheet or concrete piles, wherein the impact pile driving device of metal sheet or concrete piles comprises an apparatus according to claim 1.

13. Method for noise attenuation in when using an impact pile driving device for driving metal sheets or concrete piles, the method comprising the following steps:

providing an apparatus according to claim 1 or an impact pile driving device;

placing the upper end part of a metal sheet or concrete pile to the drive cap:

operating the compressing arrangement such as to compress the pile transversally;

wherein the metal sheet or concrete pile is thereby centralized in the middle of the drive cap so that the central axis of the pile and the central axis of the moving ram block of the hammer coincide; and starting the hammer to begin driving.

14. Use of the apparatus for noise attenuation according to claim 1 or an impact pile driving device for driving a metal sheet or a concrete pile into a ground.

15. The method according to claim 13, wherein the metal sheet piles have circular, rectangular or another closed cross section, or piles formed of open profiles with a sheet structure, such as I, L, T, Z, or H profiles.

16. The method according to claim 13 wherein the metal sheet or concrete pile is compressed from each direction at whole cross-section or at plurality of points being opposite to each other in respect of the metal sheet or concrete pile such that the metal sheet or concrete pile is centralized in respect to the hammer and the drive cap by the compressing arrangement.

* * * * *